United States Patent [19]

Mansson et al.

[11] 4,074,520

[45] Feb. 21, 1978

[54] COMBUSTION CHAMBER FOR GAS TURBINE

[75] Inventors: Martin Mansson; Ragnar Torstenfelt, both of Finspong, Sweden

[73] Assignee: Stal-Laval Turbin AB, Finspong, Sweden

[21] Appl. No.: 711,675

[22] Filed: Aug. 4, 1976

[30] Foreign Application Priority Data

Aug. 5, 1975 Sweden ..... 7508805

[51] Int. Cl.[2] ..... F02C 7/20

[52] U.S. Cl. ..... 60/39.32; 60/39.36; 60/39.65

[58] Field of Search ..... 60/39.32, 39.36, 39.37, 60/39.74 R, 39.71, 39.65

[56] References Cited

U.S. PATENT DOCUMENTS

| | | | |
|---|---|---|---|
| 2,801,520 | 8/1957 | Highberg | 60/39.65 |
| 3,433,015 | 3/1969 | Sneeden | 60/39.71 |

*Primary Examiner*—Robert E. Garrett

*Attorney, Agent, or Firm*—Pollock, Vande Sande & Priddy

[57] ABSTRACT

An improved combustion chamber for devices such as gas turbines includes a flame tube having burners and a center tube extending through its end wall. The openings for the burners and the center tube are co-planar in the end wall to allow some angular movement of the flame tube relative to the center tube. A bayonet joint between the flame tube and the center tube includes a spherical bearing surface to permit such angular movement but to prevent axial movement. A unique locking pin geometry is also disclosed.

5 Claims, 4 Drawing Figures

COMBUSTION CHAMBER FOR GAS TURBINE

BACKGROUND OF THE INVENTION

The present invention relates to combustion chambers of the type particularly suited for use in gas turbine machinery. Prior art combustion chambers of this type are rather complicated constructions which are fitted into still more complicated gas turbine constructions. Often several combustion chambers are located in a ring around the main shaft of the gas turbine and obliquely directed toward the main shaft. It may then be difficult to adjust the various parts in relation to each other so that the flame and center tubes of the chamber are positioned exactly co-axially of each other. Therefore, a certain angular deviation between the longitudinal axes of these tubes must be tolerated. Excessive deviation between such tubes, however, can result in undesirable constriction of the space around the burner elements.

OBJECTS OF THE INVENTION

An object of the invention is to provide a combustion chamber for gas turbine machinery which is simple to manufacture and assemble.

Another object of the invention is to provide such a combustion chamber in which small angular misalignment of the flame tube and center tubes can be permitted without unduly constricting the combustion burners.

Still another object of the invention is to provide such a combustion chamber in which the flame and center tubes are secured against axial movement in the upstream and downstream directions yet may undergo small angular misalignments.

A still further object of the invention is to provide a combustion chamber in which the flame and center tubes are interconnected via a spherical joint to permit angular deviation and prevent downstream movement and a lock pin to prevent upstream movement.

These objects of the invention are given only by way of example. Thus, other advantages and desirable objects inherently achieved by the disclosed structure may occur to those skilled in the art. Nonetheless, the scope of the invention is to be limited only by the appended claims.

SUMMARY OF THE INVENTION

The above objects and other advantages are achieved by the combustion chamber according to the invention in which the flame tube includes a plurality of openings in its upstream end wall for receiving the center tube and burners, the openings being located in a single plane. To secure and block the flame tube in the downstream direction in relation to the center tube, the parts are provided with radially inwardly and outwardly extending collars which rest against each other when the device is assembled. So that these collars do not prevent the angular deviation desired between the longitudinal axes of the flame tube and the center tube, the collars are formed with spherical support surfaces. To provide ease of assembly, the collars are also provided with bayonet joint structure which may be secured from relative rotation by a unique locking pin.

DETAILED DESCRIPTION OF THE PREFERRED EMBODIMENT

Figure 1:
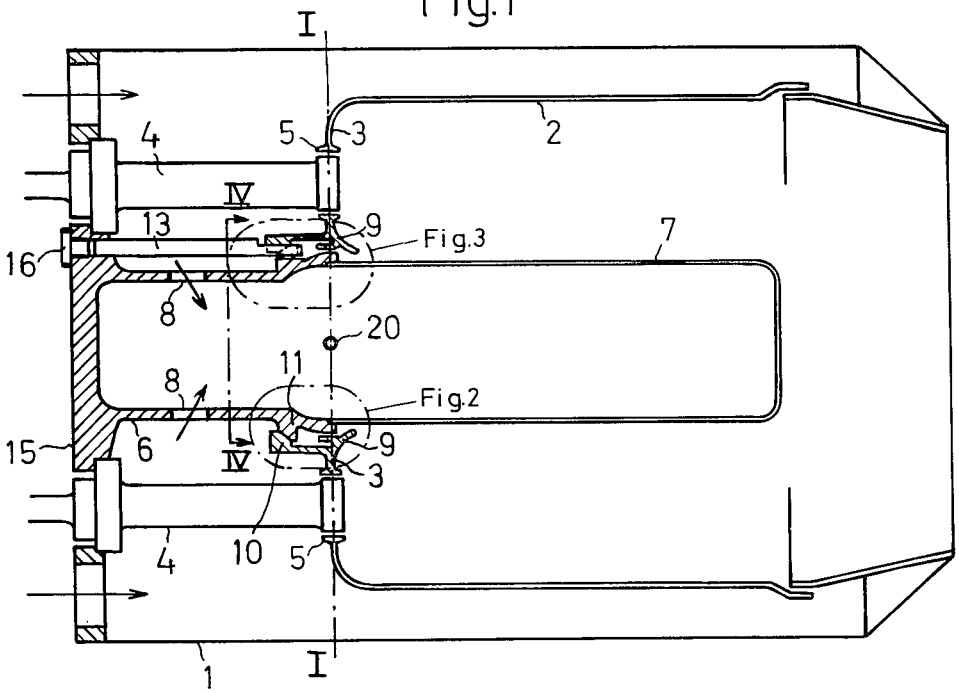
FIG. 1 shows a schematic, longitudinal section through a combustion chamber according to the invention.

There follows a detailed description of the preferred embodiment, reference being had to the drawing in which like reference numerals identify like elements of structure in each of the several figures.

FIG. 1 shows a combustion chamber according to the invention having an outer mantle 1, and a cylindrical flame tube 2 with a substantially planar upstream end wall 3. Fuel injectors or burners 4 are arranged in a circle around the edge of end wall 3 and pass through short bushings 5 in end wall 3 so that a fuel-air mixture is injected into flame tube 2. At the center of the combustion chamber there is a center tube which consists of a hollow upstream support portion 6 located outside wall 3 of flame tube 2 and a hollow downstream flow guide portion 7 located inside flame tube 2.

Figure 2:
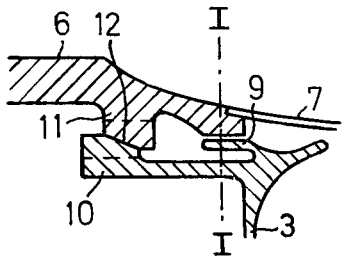
FIGS. 2 and 3 show enlarged views of portions of the structures shown in FIG. 1.
Figure 3:
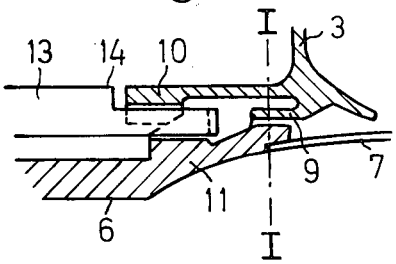

Compressed air for combustion and for diluting the combustion gases is supplied to the combustion chamber in the direction of the arrows and is led in between the outer mantle 1 and the flame tube 2. Flame tube 2 is provided with perforations and openings (not shown) in various directions in order to obtain proper air streaming therethrough. Further, support portion 6 of the center tube is provided with radial holes 8, through which air is forced into flow guide portion 7 in the flame tube. Like the flame tube 2, flow guide 7 is provided with holes and perforations (not shown) through which part of the air from the combustion chamber is pressed into flame tube 2 from its center. End wall 3 of flame tube 2 rests on center tube 6, 7 by means of a bushing 9, as shown more clearly in FIGS. 2 and 3.

As mentioned earlier, the downstream end of the flame tube 2 and the mantle 1 will not always be exactly coaxial with the center tube 6 or 7. To allow a certain angular deviation between the longitudinal axes of flame tube 2 and center tube 6, 7 without risking undue constriction between the end wall 3 of the flame tube on the one hand; and center tube 6, 7 and burners 4 on the other hand, bushings 9 and 5 are arranged according to the invention in the same plane I—I of end wall 3. In this way, minor angular deflections of the flame tube 2 will only result in essentially axial displacements of the said bushings, which is permitted without difficulty by the bushings.

To prevent flame tube 2 from being blown away in the direction of the air stream, flame tube 2 is provided with a radially inwardly-turned collar 10 which rests against a radially outwardly-turned collar 11 on the upstream support portion 6 of the center tube. To prevent this axial support from effecting the movability of the radial support from the bushing 9, the collars 10, 11 are placed upstream in relation to the bushing 9. Such a location of the collars 10, 11, however, could have an effect on the free angular movability between the flame tube 2 with its end wall 3 and the center tube 6, 7 and the burners 4. The difficulty is avoided according to the invention since support surfaces 12 on collars 10, 11 are made spherical having a center of curvature at a point 20 located in plane I—I on the axis of the flame tube. In this way flame tube 2 is able, within certain limits, to move freely around the point 20.

When the flame tube 2 is to be mounted, it is fitted over the center tube in upstream direction, first over flow guide 7 and then over a part of the support portion 6. The collar 10 on the flame tube must then pass the collar 11 on the center tube. To make this possible, the collars 10 and 11 have been provided with milled-out recesses shown by dashed lines in FIG. 2.

Figure 4:
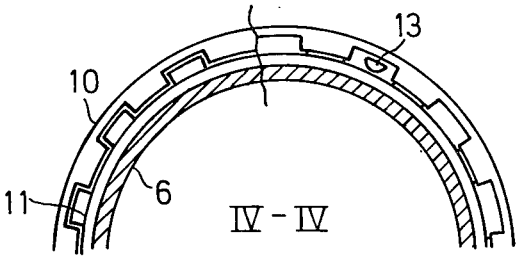
FIG. 4 shows a partial section taken on line IV—IV of FIG. 1 indicating the positions of the bayonet joint according to the invention during assembly and after locking.

The geometry of collars 10 and 11 is illustrated more clearly in FIG. 4. The left-hand side of FIG. 4 shows the collars 10 and 11 during assembly where the recesses in one collar correspond to the remaining, cog-like parts of the other collar; while the right-hand side shows how the collars have been rotated into locked position. In accordance with the principle of a bayonet joint, the gears of the two collars rest against each other. To secure flame tube 2 in this position, a locking pin 13 has been introduced in one of the recesses in the collars. Since the outer end of locking pin 13 has been milled down to about half its thickness, an edge 14 is formed which blocks flame tube 2 from movement in the upstream direction. Locking pin 13 is passed through a hole in a flange 15 on the end wall of the center tube 6 and may be fixed by means of a screw 16.

Having described our invention in sufficient detail to enable those skilled in the art to make and use it, we claim:

1. In a combustion chamber of the type adapted for use with a gas turbine, said chamber including an outer mantle; a cylindrical flame tube arranged within said outer mantle, said flame tube having an upstream end wall; a center tube extending within said flame tube through a central opening in said end wall, said central opening being sized to permit movement of said end wall relative to said center tube and said center tube being provided with openings to pass air into the center of said flame tube; and a plurality of burnes arranged around said center tube and extending into said flame tube through a corresponding plurality of openings in said end wall, each of said plurality of openings being sized to permit movement of said end wall relative to said burners, the improvement comprising: the placement of said central opening and said plurality of openings in said end wall of said flame tube for said center tube and said burners in a common plane, whereby a certain angular deviation between the longitudinal axis of said flame tube and said center tube is permitted.

2. The improvement of claim 1 wherein said flame tube comprises a radially inwardly-turned collar and said center tube comprises a radially outwardly turned collar, said inwardly and outwardly turned collars having spherical mating surfaces with their center of curvature lying in said common plane, whereby said angular deviation is permitted and said flame tube is prevented from downstream movement.

3. The improvement of claim 2 wherein said collars comprise cut-out portions to form a bayonet joint.

4. The improvement of claim 3, wherein a locking pin is inserted through at least one of said cut out portions to prevent rotation of said bayonet joint.

5. The improvement of claim 4, wherein said pin is provided with an edge on which said center tube bears upon movement of said center tube in the upstream direction, whereby upstream movement of said center tube is limited.

* * * * *